US006422880B1

(12) United States Patent
Chiu

(10) Patent No.: US 6,422,880 B1
(45) Date of Patent: Jul. 23, 2002

(54) SAFETY SOCKET HEAD

(76) Inventor: Shun-Kuo Chiu, 390, Chu Liao Rd., Chu Liao Tsuen, Dah Shuh Shiang, Kaohsiung Hsien (TW)

( * ) Notice: Subject to any disclaimer, the term of this patent is extended or adjusted under 35 U.S.C. 154(b) by 0 days.

(21) Appl. No.: 09/799,919

(22) Filed: Mar. 7, 2001

(51) Int. Cl.[7] ..... H01R 13/44
(52) U.S. Cl. ..... 439/137; 439/145
(58) Field of Search ..... 439/135–145, 439/93

(56) References Cited

U.S. PATENT DOCUMENTS 4,600,258 A * 7/1986 Hu ..... 439/145
5,449,860 A * 9/1995 Buckshaw et al. ..... 439/145
6,056,564 A * 5/2000 Huang ..... 439/145
6,086,391 A * 7/2000 Chiu ..... 439/145
6,217,353 B1 * 4/2001 Yu-Tu ..... 439/145

* cited by examiner

*Primary Examiner*—Hien Vu
(74) *Attorney, Agent, or Firm*—Raymond Y. Chan; David and Raymond Patent Group

(57) ABSTRACT

An electrical socket comprises an insertion hole portion, an upper slide block, a lower slide block, and an upper cover. The insertion hole portion is provided in the top with an open slot dimensioned to accommodate the upper slide block and the lower slide block. The insertion hole portion is provided in the top and the side edge with a recessed slot, with which the upper cover is joined. The assembly of the socket is done with ease and speed, thereby resulting in reduction in production cost.

1 Claim, 4 Drawing Sheets

SAFETY SOCKET HEAD

FIELD OF THE PRESENT INVENTION

The present invention relates generally to an electrical socket, and more particularly to a safety socket which is simple in construction and can be easily assembled to enhance the productivity.

BACKGROUND OF THE PRESENT INVENTION

This inventor of the present invention filed a U.S. patent application, with the patent title being "Safety Socket Head" and with the Ser. No. being 09/066,830. The application was allowed for issuance on Jul. 1, 2000, with the U.S. Pat. No. being 6,086,391. The safety socket is now sold in the market and is well received by the consumer. This inventor of the present invention continues to research and develop the new products in the field of the electrical socket such that the electrical socket production can be automated. This inventor of the present invention has found that the internal structures of the insertion hole portion of the safety socket head disclosed in the above-mentioned U.S. Patent are not symmetrical leftward and rightward. As a result, the assembly of the insertion hole portion calls for special attention to the left directionality and the right directionality, so as to reduce the rejection rate of the product as well as the assembly time.

SUMMARY OF THE PRESENT INVENTION

The primary objective of the present invention is to provide a safety socket head, which can be assembled without regard to the left directionality and the right directionality, thereby resulting in reduction in rejection rate of the product. The production efficiency of the safety socket head is thus improved substantially.

DETAILED DESCRIPTION OF THE PREFERRED EMBODIMENT

Figure 1:
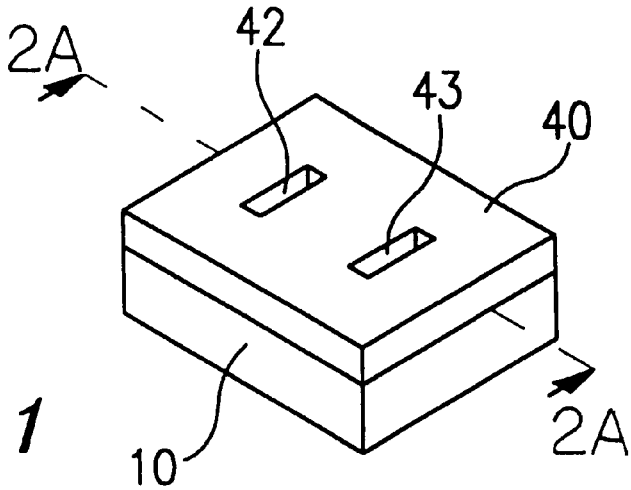
FIG. 1 shows a perspective view of the present invention.
Figure 2:
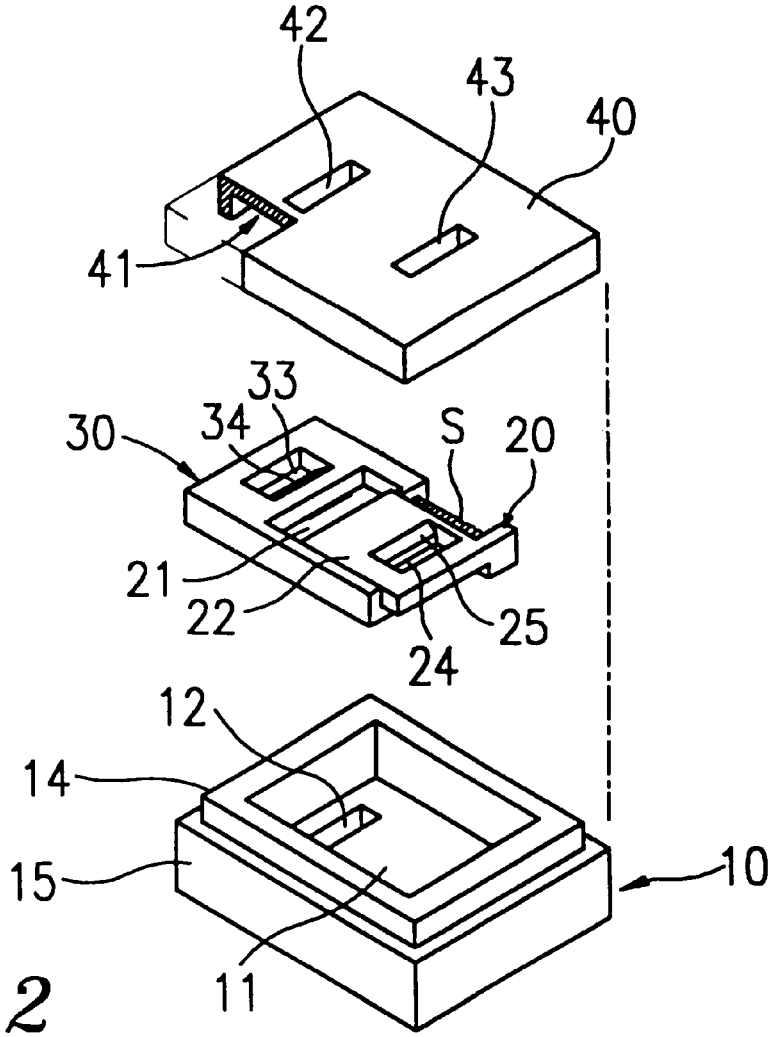
FIG. 2 shows an exploded view of the present invention.
Figure 3:
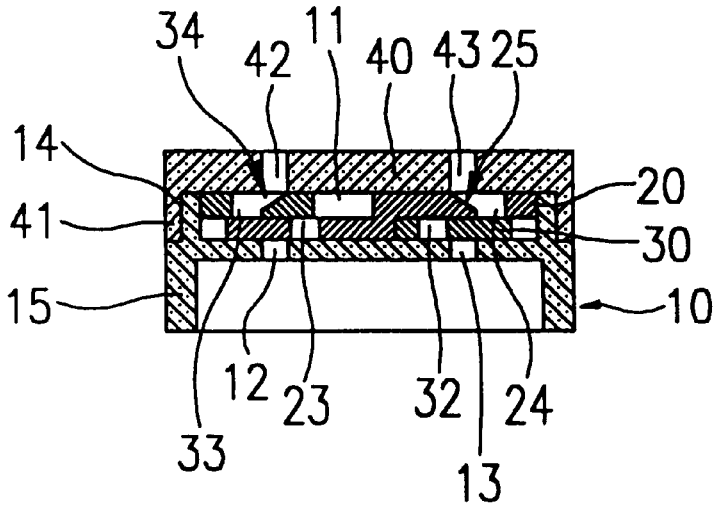
FIG. 3 shows a sectional view taken along a line A—A as shown in FIG. 1.

As shown in FIGS. 1–8, a safety socket structure embodied in the present invention comprises an insertion hole portion 10, an upper slide block 20, a lower slide block 30, and an upper cover 40. The insertion hole portion 10 is provided in the center of the top thereof with an open slot 11 which is dimensioned to accommodate the upper slide block 20 and the lower slide block 20, as shown in FIG. 3. The open slot 11 is provided in the bottom with two lower through holes 12 and 13 into which two insertion pieces A1 of a power source plug A are inserted. The insertion hole portion 10 has an upper section 14 and a lower section 15. The upper section 14 is of a stepped construction and is smaller in area than the lower section 15 for receiving the upper cover 40, as shown in FIGS. 1 and 2. The upper cover 40 is provided in the bottom with a recess 41 which has a depth equal to the height of the upper section 14 of the insertion hole portion 10. As a result, the upper cover 40 is flush with the insertion hole portion 10 when the upper cover 40 is joined with the upper section 14 of the insertion hole portion 10. The upper cover 40 is provided with two upper through holes 42 and 43 opposite to the lower through 12 and 13 of the insertion hole portion 10.

Figure 4:
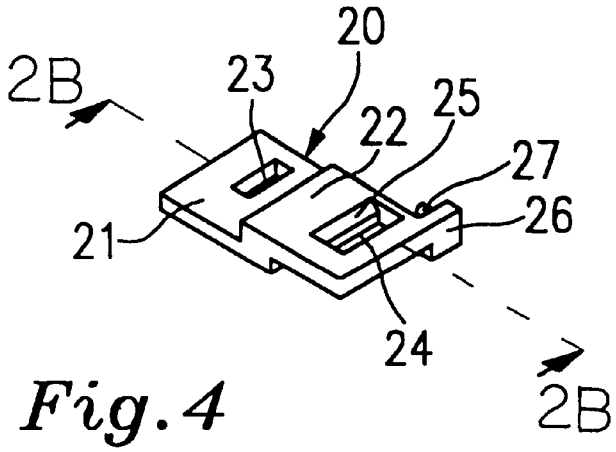
FIG. 4 shows a perspective view of an upper slide block of the present invention.
Figure 5:
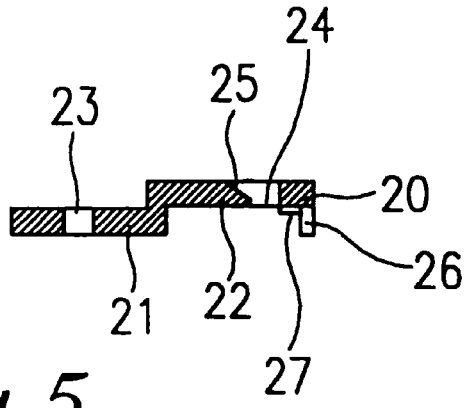
FIG. 5 shows a sectional view taken along a line B—B as shown in FIG. 4.

As shown in FIGS. 4 and 5, the upper slide block 20 has a front plate 21 and a rear plate 22. The front plate 21 is provided in the top with an upper guide insertion hole 23. The rear plate 22 is provided in the top with a guiding hole 24 for receiving an insertion piece A1. The guiding hole 24 is provided therein with an inclinded first guiding surface 25. The rear plate 22 is provided in one of the long sides thereof with a carrying plate 26 which is provided in one of the sides thereof with a carrying rod 27 for holding a compression spring 5.

Figure 6:
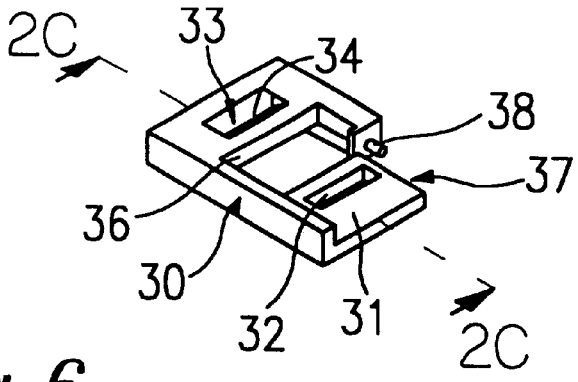
FIG. 6 shows a perspective view of a lower slide block of the present invention.
Figure 7:
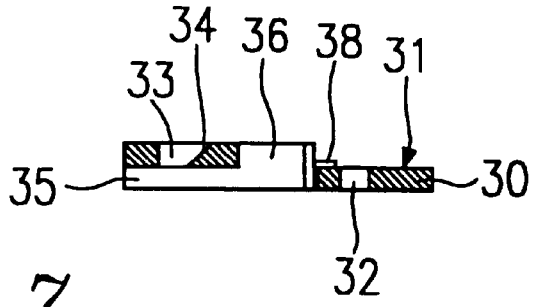
FIG. 7 shows a sectional view taken along a line C—C as shown in FIG. 6.

As shown in FIGS. 6 and 7, the lower slide block 30 is a flat long body and is provided in the top with a recessed portion 31 which is in turn provided in the center with a lower guide insertion hole 32 for receiving the insertion piece A1 and in the top with a guide insertion hole 33 located in proximity of another short side edge. The guide insertion hole 33 is provided therein with an inclined second guiding surface 34. The recessed portion 31 is provided in the inner short side with a recessed slot 35 extending toward the guide insertion hole 33. The recessed slot 35 is provided in the bottom with a hole 36 and is in communication with the recessed portion 31. The recessed portion 31 is provided in one of the long sides thereof with a recessed slot 37 which is in turn provided with a carrying rod 38 for holding a compression spring S.

Figure 8:
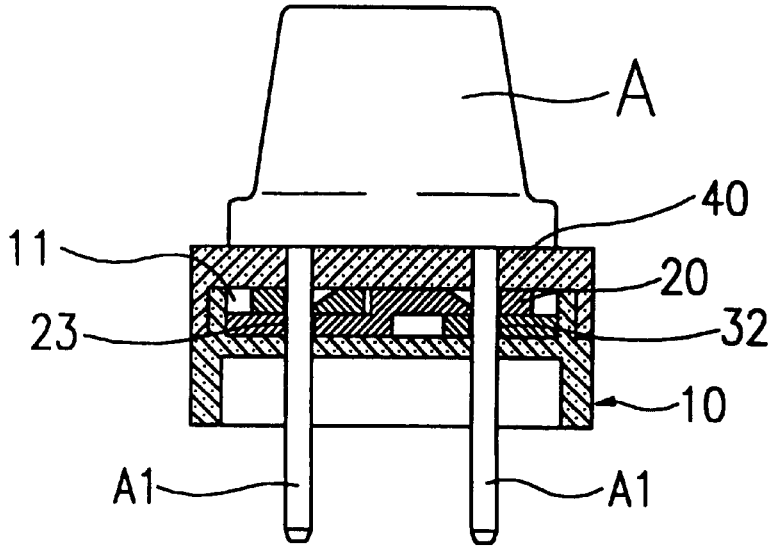
FIG. 8 shows a sectional schematic view of the present invention with a power source plug being fitted thereinto.
Figure 9:
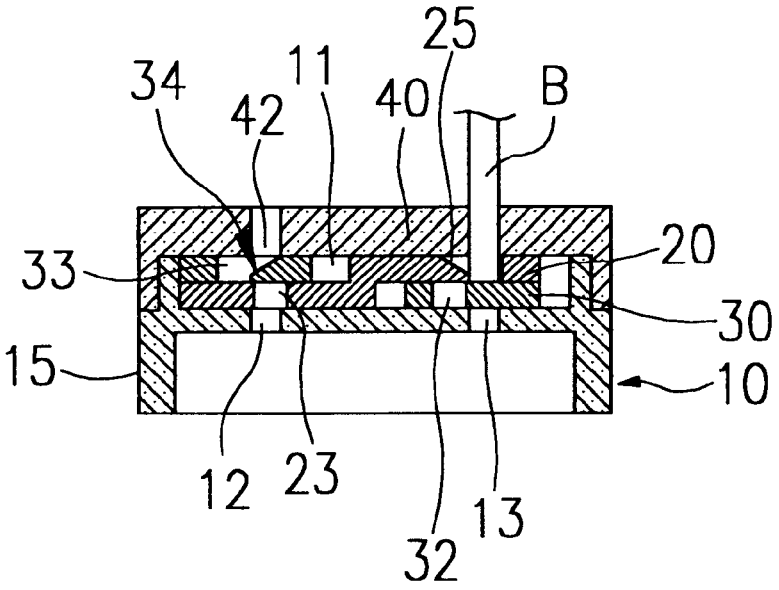
FIG. 9 shows a sectional schematic view of the present invention with a foreign object being inserted thereinto.
Figure 10:
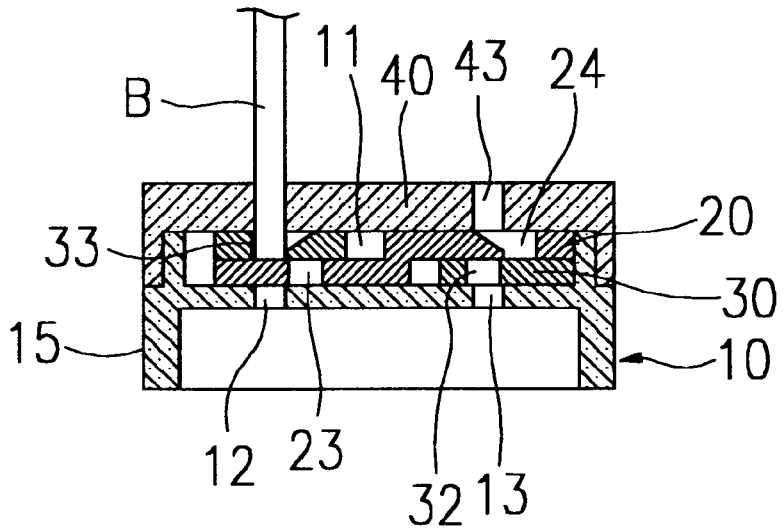
FIG. 10 shows another sectional schematic view of the present invention with the foreign object being inserted thereinto.

As shown in FIGS. 2 and 3, the upper slide block 20 and the lower slide block 30 are first joined together before they are disposed in the open slot 11 of the insertion hole portion 10. Thereafter, the upper cover 40 is joined with the top of the insertion hole portion 10 by ultrasonic finishing. The assembly is done with ease and speed, without regard to the left directionality and the right directionality at the time when the upper slide block 20 and the lower slide block 30 are disposed together in the open slot 11 of the insertion hole portion 10. As a result, the production efficiency of the safety socket of the present invention is greatly improved. Now referring to FIG. 8, the upper slide block 20 and the lower slide block 30 are caused to displace simultaneously at the time when the two insertion pieces A1 of a power source plug A are inserted. As a result, the two insertion pieces A1 are inserted into the two lower through holes 12 and 13 so as to make contact with electricity in the interior the socket. As shown in FIGS. 8–10, when a foreign object B is inserted into the upper through hole 42 or 43 of the upper cover 40, the foreign object B is stopped by the upper slide block 20 or the lower slide block 30, thereby prevention the incident of electric shock or electric leak.

What is claimed is:

1. A safety socket, comprising:

an upper cover having a recess provided on a bottom surface thereof and two upper through holes formed on a top surface thereof;

an insertion hole portion having an upper section and a lower section, wherein said upper section has a top surface having a central open slot provided thereon and a lower surface having two lower through holes provided thereon, wherein said upper section has a size smaller than that of said lower section to from a stepped construction for receiving said upper cover, wherein a height of said upper section is equal to a depth of said recess, wherein said upper cover is flush with said insertion hole portion when said upper cover is joined with said upper section of said insertion hole portion while said two upper through holes are aligned with said two lower through holes respectively for two insertion pieces of an electrical plug passing through;

an upper slide block having a front plate having an upper guide insertion hole thereon and a rear plate having a guiding hole thereon, wherein said guiding hole has an inclined first guiding surface and said rear plate further has a carrying plate protruded from a longitudinal side thereof, wherein a first carrying rod is formed an inner side of the carrying plate;

a lower slide block, which is a flat long body, having a guide insertion hole provided on a first short side, a recessed portion provided on a second short side and a recessed slot extended from said recessed portion towards said guide insertion hole, wherein a lower guide insertion hole is formed on said recessed portion and said guiding insertion hole has an inclined second guiding surface, wherein said recessed slot is provided in a bottom of said slide block with a hole and in communication with said recessed portion, wherein a recessed slot is formed at a longitudinal side of said recessed portion and a second carrying rod is protruded at one end of said recessed slot, and a compression spring which is disposed in said recessed slot and held between said first carrying rod of said upper slide block and said second carrying rod of said lower slide block;

wherein said upper slide block and said lower slide block, which are joined together by overlapping said rear plate of said upper slide block with said recessed portion of said lower slide block are disposed in said open slot of said insertion hole portion and covered by said upper cover in such a manner that said inclined first guiding surface of said upper slide block and said inclined second guiding surface are aligned right below said two upper through holes while said upper guide insertion hole and said lower guiding insertion hole are normally disalgined with said upper and lower through holes respectively, so that the two upper through holes, as well as the two lower through holes, are blocked by said front plate of said upper slide block and said recessed portion of said lower slide block respectively, whereby when two insertion pieces of an electrical plug are inserted into said two upper through holes, said two insertion pieces press against said inclined first and second guiding surfaces respectively to drive said upper slide block and said lower slide block to displace towards each other at the same time until said guiding hole and said guide insertion hole are aligned with said two upper and lower through holes respectively so as to enable said two insertion pieces inserting through said two lower through holes.

* * * * *